United States Patent [19]

Kamijo et al.

[11] 4,326,931

[45] Apr. 27, 1982

[54] PROCESS FOR CONTINUOUS PRODUCTION OF POROUS METAL

[75] Inventors: Eiji Kamijo, Itami; Kazuhito Murakami, Osaka; Katsuto Tani, Itami, all of Japan

[73] Assignee: Sumitomo Electric Industries, Ltd., Osaka, Japan

[21] Appl. No.: 950,615

[22] Filed: Oct. 12, 1978

[51] Int. Cl.[3] ..... C25D 5/54; C25D 7/06

[52] U.S. Cl. ..... 204/22; 204/24; 204/28

[58] Field of Search ..... 204/24, 20, 21, 22, 204/28, 38 B

[56] References Cited

U.S. PATENT DOCUMENTS

| | | | |
|---|---|---|---|
| 1,243,655 | 10/1917 | Clark | 204/24 |
| 2,042,030 | 5/1936 | Tainton | 204/24 |
| 2,474,502 | 6/1949 | Suchy | 204/21 |
| 3,549,505 | 12/1970 | Hanusa | 204/22 |

*Primary Examiner*—T. M. Tufariello

*Attorney, Agent, or Firm*—Wenderoth, Lind & Ponack

[57] ABSTRACT

A process for continuous production of porous metal in a tape form is disclosed which comprises the steps of treating a non-conductive porous tape to give its skelton surface electrical conductivity and then moving the porous tape in an electrolytic bath in close contact with a moving cathode immersed in said bath to electroplate it to a predetermined thickness.

5 Claims, 5 Drawing Figures

PROCESS FOR CONTINUOUS PRODUCTION OF POROUS METAL

The present invention relates to a process for continuous production of porous metal in a tape form comprising the steps of giving electrical conductivity to a non-conductive porous tape of an organic or inorganic material and electroplating it to a predetermined thickness.

In electroplating a porous sheet or tape, uniform deposition in its pores is required. This poses a large problem. The difficulty in achieving uniform deposition arises due to the fact that the current density varies in a direction of thickness, that is, from the surface of the tape to its inner layer. The larger the specific resistance of the electrically conductive layer on the surface of the porous tape, the larger the voltage drop at its inner layer. Thus, the current density is higher at the surface layer than at the inner layer. Therefore, liberated metal ions are deposited mainly on the surface layer whereas they run short at the inner layer. This phenomenon occurs not only due to the specific resistance of the electrically conductive layer but also due to the difference in the resistance of electrolyte resulting from the difference in the distance between the cathode and the anode, and due to polarization at the interface between cathode and electrolyte.

Generally, the plating speed is proportional to the product of current density and current efficiency. In electroplating a porous member, however, if the current density were increased too much, it might become excessive at the surface layer so that metal ions run short in the inner layer owing to excessive polarization. Therefore, the current density eventually exceeds the permissible limit so that crystals in the form of twig, sponge or powder, such as of nickel hydroxide, separate out.

If the ratio of the current density at the surface layer to that at the inner layer were too large, the difference in the plating thickness between the surface layer and the inner layer and the variation in density in the direction of product thickness would become excessive.

Also, if the specific resistance of the electrically conductive layer were too large, the voltage drop at the tape being plated would become excessive and the bath voltage would increase extremely. This makes it necessary to control the current density. Thus, for the electroplating of electrically non-conductive porous members, only one-tenth to one-hundredth the current density normally used for plating ordinary plates or wires can be used.

In order to assure uniform plating and increase the working current density and thus the productivity, it is necessary to minimize the specific resistance of the electrically conductive layer and to improve the plating process, thereby minimizing the voltage drop at the tape being plated.

Among the methods for giving a porous tape electrical conductivity, there are electroless plating, coating with an electrically conductive paint containing powder of carbon, silver, copper, etc., and vacuum evaporation of metal. However, the methods by which the specific resistance can be minimized have disadvantages of high equipment cost or difficulty of operation.

Generally, for continuous plating of a cathode in a tape form, feeding rolls outside of the bath are used for supplying current. Such a conventional method is effective for metal tapes having a very small specific resistance. But, if it were used for plating a porous tape, which has a specific resistance $10^2$ to $10^5$ times that of such metal tapes, the skelton of the porous tape would constitute a resistance which causes a large voltage drop and produces a large variation in the current density in a horizontal direction. In other words, if the conventional method is used for plating such a porous body, the production capacity is extremely low because the current density used is limited. Tests show that for the working current density of 0.1–1 A/dm$^2$, the feed speed is 0.1–1 cm/min.

An object of this invention is to provide a process for continuous production of porous metal in a tape form which requires equipment of a relatively small size and which increases the working current density by 10 to 15 times and the feed speed by 10 to 50 times, thereby increasing the production drastically, and which provides uniform plating thickness.

In other words, the present invention provides a process for electroplating with substantially uniform current density a porous tape which has been treated to give its surface electrical conductivity.

One problem in this type of electroplating is that such a porous tape to be plated has a specific resistance on the order of $10^2$ to $10^5$ times that of metal tape even after it has been treated to render it electrically conductive. An effective method for electroplating such a body having a large specific resistance is to apply voltage to the porous tape in contact with a feeding terminal in an electrolytic bath. In this process, it is important to avoid the separation or deposition of metal on the feeding terminals immersed in the electrolytic bath. Such a deposition would not only waste the anode metal and the plating power but also impair the smoothness of the terminal surface and damage the tape being plated.

One solution to this problem is to pass the porous tape in an electrolytic bath in close contact with a cathode in the form of a rotary drum. In this arrangement, the feeding terminal in the bath, that is, the drum cathode, is not directly exposed to the electrolyte, but is completely closed up by the tape to be plated so that little plating metal deposits on the surface thereof.

Other objects and advantages of the present invention will become apparent from the following description taken with reference to the accompanying drawings, in which:

Referring now to the drawings, wherein like reference characters designate like or corresponding parts throughout the views, FIG. 1 illustrates a schematic view of the first embodiment of the process according to this invention.

Figure 1:
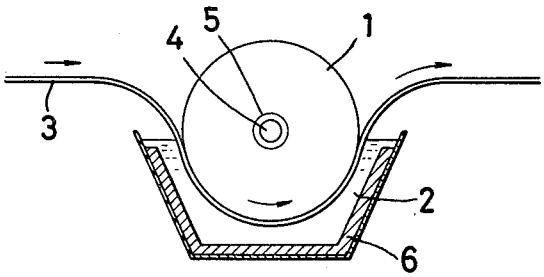
FIG. 1 is a schematic view of the first embodiment of the process according to the present invention.

The feeding drum 1 immersed in an electrolytic bath 2 is rotated by a driving means (not shown) at a constant speed. Electric current is supplied through a slip ring 5 mounted on a drum shaft 4 so that a predetermined voltage will be applied between the feeding drum 1 and an anode 6. A porous tape 3 having its skelton surface rendered electrically conductive is in close contact with the outer periphery of the feeding drum 1 in the bath 2. Thus, it runs at the same speed as the feeding drum 1 while being electroplated.

In this method in which electric current is fed to the tape to be plated from the feeding drum kept at a uniform potential, the distance from the feeding drum is maximum on the surface of the porous tape, the maximum distance being substantially equal to the thickness of the tape. Thus, the potential increase due to the electrical resistance of the tape is almost negligible. This permits the use of a current density of a few $A/dm^2$ even when the tape has a relatively high resistance, such as the tape coated with an electrically conductive carbon paint.

Figure 2:
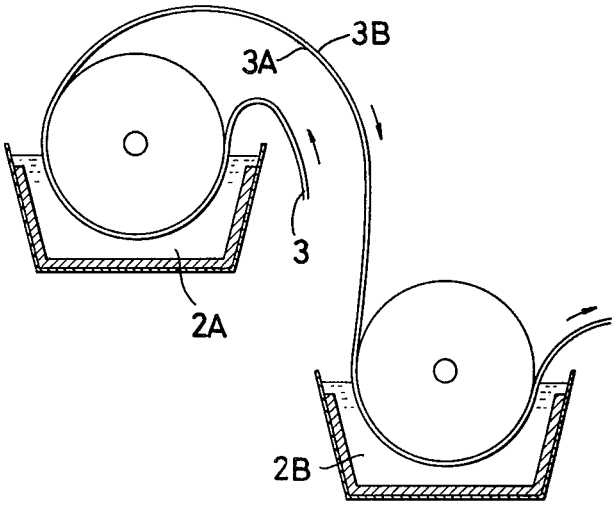
FIG. 2 is a schematic view of the second embodiment thereof.

However, this process has a disadvantage that the plating conditions differ with the sides of the tape. As its outer side facing the anode 6, metal ions are consumed by deposition whereas at its inner side adjacent to the cathode roll, the lack of ions occurs. The smaller the pore diameter of the porous sheet, the more remarkable this tendency. This condition is disadvantageous because the amount of deposition on the tape skelton differs with the sides of the product. To avoid this tendency, the arrangement of FIG. 2 is preferable in which two baths identical to the bath 2 in FIG. 1 are employed to treat both sides of the tape alternately under substantially the same conditions. In this arrangement, more ions are deposited on the side 3B of the tape in the bath 2A and on the side 3A in the other bath 2B. Any even number of baths may be employed, instead of two. This assures uniform deposition of ions to either side of the tape.

Figure 3:
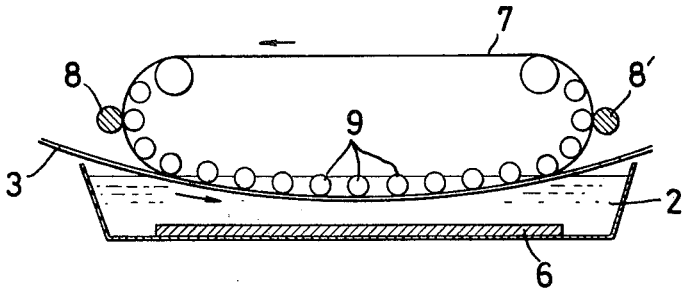
FIG. 3 is a schematic view of the third embodiment thereof.

This process using a rotary drum cathode requires high equipment cost because the cathode is of a circular cross-section. In order to achieve the same effect with reduced equipment cost, an electrically conductive belt continuously movable in the bath may be employed instead of a cathode drum. FIG. 3 shows an embodiment in which an electrically conductive belt 7 is immersed in the electrolytic bath 2 and fed by a suitable driving means (not shown) at a constant speed on a route defined by a plurality of guide rolls 9. The conductive belt 7 may be either endless as illustrated or in the form of a strip fed back and forth. Electric current is supplied from a pair of feeding terminals 8, 8' to the conductive belt 7 to apply a predetermined voltage between the belt and the anode 6. A porous tape 3 having its skelton surface treated to render it electrically conductive is kept at a predetermined potential in the bath because it is in close contact with the conductive belt 7. The tape 3 is fed at the same speed as the belt 7 while being electroplated. Preferably, the conductive belt 7 is guided by guide rolls 9 in the bath 2 so as to run at some curvature in order to ensure close contact between the conductive belt and the porous tape. Press rolls may also be used to press the porous tape 3 against the conductive belt 7. The use of such a conductive belt as cathode, makes it possible to achieve the same result as when the cathode in the form of a drum as used in FIGS. 1 or 2, with reduced equipment cost. In this embodiment also, any even number of electroplating baths are preferably used to assure uniform deposition onto both sides of the tape.

Figure 4:
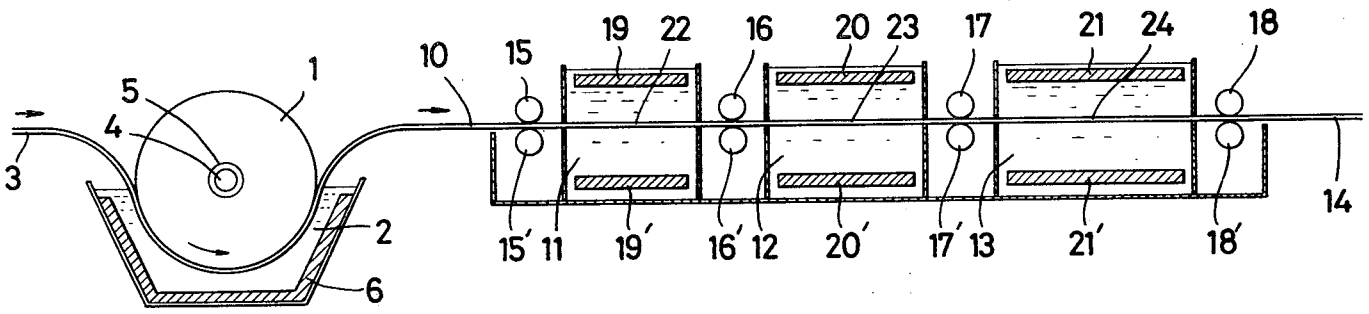
FIG. 4 is a schematic view of the fourth embodiment thereof.

In the above-mentioned process in which the porous tape being treated is bent in one direction and bent back in the other direction as it moves from one bath to the next one, the tape might have cracks on its surface due to bending strain, particularly where it has a relatively large thickness. Another problem of such processes in which the porous tape is plated in close contact with the cathode is that the amount of deposition is less in the middle layer of the tape in the direction of the thickness than on its surface, where the porous tape has a relatively large thickness and a small pore diameter. In case such disadvantage may occur, the process as illustrated in FIG. 4 may be employed in which the tape is plated in close contact with the cathode in the first step and is further plated out of contact with the cathode, that is, by the ordinary method using feeding rolls outside of the bath in the second and subsequent steps.

In more detail, the porous tape having its skelton surface treated to render it electrically conductive undergoes the first step of plating in which it is fed in close contact with a rotary metal feeding drum as shown in FIG. 1 or a continuously moving conductive belt as in FIG. 3 to deposit a layer 0.1 to a few microns thick. This means that the porous tape now has a second electrically conductive layer and has considerably reduced specific resistance. This allows the use of a relatively high current density ($10A/dm^2$ or more) even from feeding rolls outside the bath in the second and subsequent steps of plating by which deposition is attained to a required thickness. In the first plating in which the tape is plated from one side thereof, not from both sides, a plating thickness of 0.1 to a few microns is sufficient because the function of this first step of plating is to reduce the specific resistance of the thing to be plated. Since the amount of deposition is mainly determined by the second and subsequent platings, the difference in the amount of deposition between the sides of the tape in the first plating eventually becomes negligible. However, where even such a slight difference is undesirable, the first step of plating may be subdivided to treat the tape in two baths as mentioned above.

Since the porous tape is given only such a small plating thickness (0.1 to a few microns) in the first step of plating, it retains the original flexibility. Thus, it is not liable to have cracks due to bending in the first plating.

In this process, the first step takes only a relatively short time because of such a small plating thickness. The tape feed speed, which is mainly determined by the required amount of deposition in the second and subsequent steps, is 10–50 cm/min. This speed normally corresponds to a current density of $10A/dm^2$ or more.

In the arrangement of FIG. 4, the first plating is preformed in the same way as in FIG. 1. The same reference numbers are used for the same parts.

In the second plating and thereafter, the tape to be plated should be supplied with a plating current at intervals appropriate for its specific resistance. In the process according to this invention, the tape to be plated has the maximum specific resistance when it has a skelton coated with an electrically conductive layer. Its specific resistance decreases gradually as metal is deposited on its surface. Thus, at an early stage of plating, the distance between the feeding terminals should be short to keep the voltage drop above the largest permissible limit, which is normally about 10% of the voltage between anode and cathode, though this depends on the length of equipment, the desired production speed, etc. Because the specific resistance decreases as plating proceeds, the distance between the feeding terminals may be increased gradually at a later stage of plating.

In FIG. 4, the porous tape 10 which has been treated in the bath 2 is further plated in plating baths 11, 12 and 13 so that a porous metal sheet 14 is produced. The porous tape 10 is first plated in a bath 11, kept at a negative potential relative to anodes 19, 19' by two pairs of feeding rolls 15, 15' and 16, 16'. The potential at the porous tape 10 increases with an increase in the distance from each pair of the feeding rolls 15, 15' (16, 16') until it becomes maximum at the middle point 22. The potential there depends on the current density used and the length of the tape to be plated between the feeding rolls 15, 15' and 16, 16'. Thus, it is possible to keep the potential increase at the middle point 22 below the permissible limit by setting the distance between the pairs of the feeding rolls at a suitable value according to the current density used. This is true for the second and third baths 12 and 13 for which the distance between the feeding rolls 16, 16' and 17, 17' and that between 17, 17' and 18, 18' are in question, respectively. As will be seen from FIG. 4, the distance between the feeding rolls may be increased because the specific resistance of tape decreases as it passes from the bath 11 to bath 12 and then to bath 13.

Although the arrangement of FIG. 4 includes three baths, the same is true if the system comprises more than three baths.

In the process according to this invention, the production capacity can be increased as desired by increasing the diameter of the feeding roll for the first plating step and the number of baths in the second and subsequent steps, which makes it possible to increase the tape feed speed. Any increase in the equipment width also increases the production per unit time. There is no possibility that an increase in the system width causes poor uniformity of deposition in the direction of width because plating progresses simultaneously over the entire width of the tape.

Figure 5:
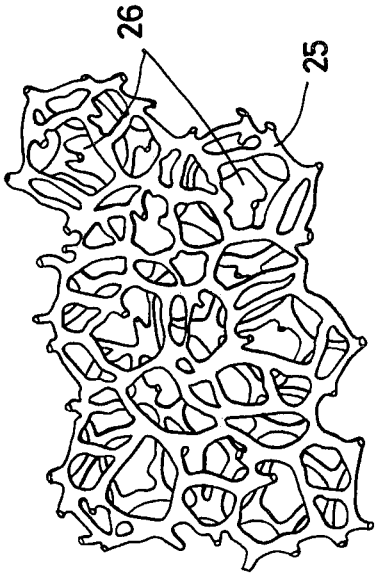
FIG. 5 is a partial enlarged view of a three-dimensional irregular reticulate porous member, i.e. one of the porous metal tapes produced by the process according to the present invention.

The process according to this invention is effective whether the porous body is planar or cubic. However, it is effective particularly for cubic porous members. The porous body may be a three-dimensional recticular structure, unwoven structure, or honeycomb structure. FIG. 5 is a partial enlarged view of a three-dimensional, irregular, recticular metal porous body in which the numerals 25 and 26 designate the skelton and the pores respectively.

There is also some possibility of porous bodies being electroplated with air bubbles entrapped in the pores thereof. Such air bubbles would interfere with satisfactory desposition. Preferably, pure water or an electrolyte should be sprayed onto the porous tape to drive the air bubbles out of the pores, before the tape enters the electrolyte. The addition of a surface active agent to the electrolyte is also effective.

While the invention has been particularly shown and described with reference to embodiments, it will be understood that changes and variations may be made without departing from the scope of this invention.

What are claimed are:

1. A process for continuously plating a non-conductive porous tape, comprising the steps of:

treating said tape to render it electrically conductive, moving said electrically conductive tape through an electrolytic bath in close contact with a moving cathode immersed in said bath to electrodeposit a layer of metal on the surface of said tape to increase the electrical conductivity of said tape, and electroplating said tape having increased electrical conductivity in a plurality of electrolytic baths each having feed rolls outside the bath for feeding said tape into the bath to electroplate said tape to a desired thickness.

2. A process as claimed in claim 1 wherein the distance between adjacent feed rolls outside said plurality of electrolytic baths increases in the feed direction of said tape through said plurality of electrolytic baths.

3. A process as claimed in claim 1 wherein said moving cathode is a rotary drum.

4. A process as claimed in claim 1 wherein said moving cathode is an electrically conductive sheet continuously moving in said electrolytic bath.

5. A process as claimed in claim 1, 3 or 4 wherein said porous tape has a three-dimensional recticular structure.

* * * * *